US007988495B2

(12) United States Patent
Chung

(10) Patent No.: US 7,988,495 B2
(45) Date of Patent: Aug. 2, 2011

(54) CONNECTOR

(75) Inventor: Hsuan-Ho Chung, Bade (TW)

(73) Assignee: DNOVA Corporation, Taipei (TW)

( * ) Notice: Subject to any disclaimer, the term of this patent is extended or adjusted under 35 U.S.C. 154(b) by 0 days.

(21) Appl. No.: 12/625,895

(22) Filed: Nov. 25, 2009

(65) Prior Publication Data

US 2011/0124234 A1 May 26, 2011

(51) Int. Cl.
*H01R 24/00* (2006.01)

(52) U.S. Cl. ..... 439/660; 439/607.35; 439/76.1

(58) Field of Classification Search ..... 439/607.35, 439/607.38, 607.4, 660, 76.1
See application file for complete search history.

(56) References Cited

U.S. PATENT DOCUMENTS

2006/0003639 A1* 1/2006 Ishizuka et al. ..... 439/660
2008/0009197 A1* 1/2008 Lin ..... 439/660
2009/0117784 A1* 5/2009 Wu ..... 439/660
2010/0159747 A1* 6/2010 Chang ..... 439/607.35
2010/0173529 A1* 7/2010 He et al. ..... 439/660
2010/0184329 A1* 7/2010 Hou et al. ..... 439/607.01

* cited by examiner

*Primary Examiner* — Hien Vu
(74) *Attorney, Agent, or Firm* — Leong C. Lei

(57) ABSTRACT

The present invention relates to a connector, wherein a connector is defined with an opening for connecting a USB connector. The connector is mainly assembled from a hollow casing, a first base and a second base, and two rear side walls of the hollow casing are respectively formed with a position fixing portion extending away from the opening. Moreover, after fixedly combining together the first base and the second base, two sides thereof are respectively formed with a guiding portion, which enable fixing portions extending from two sides of a printed circuit tongue to effect sliding inserted disposition. After assembly of the bases with the printed circuit tongue, then the fixing portions enable fastening to the position fixing portions. Accordingly, the bases not only enable achieving the objective of product customization, but also retaining positioning of the connector is enabled to prevent errors from occurring due to displacement.

2 Claims, 9 Drawing Sheets

CONNECTOR

BACKGROUND OF THE INVENTION (a) Field of the Invention

The present invention provides a connector, and more particularly provides a connector that enables changing the assembled form according to user needs, while at the same time retaining positioning of the connector.

(b) Description of the Prior Art

Current use of electronic equipment is considerably widespread, with connectors being primarily used to establish a connection relation between electronic equipments. Moreover, the use of connectors on current printed circuit tongues is already extremely common, such as the various forms of connector ports, which are all completed via connectors. Printed circuit tongues of all types of electronic products, including familiar devices such as computer motherboards, mobile phone printed circuit tongues, and the like, are all equipped with connectors enabling connection with external devices, thereby enabling mutual connection between electronic products and data exchange therebetween, or connection to the Internet, and so on.

Taking a general USB (Universal Serial Bus) connector as an example, which, early in its development, was a USB connecting interface, and such a USB (plug and play) can be said to have provided convenience to many users, the user being able to insert a device provided with a USB interface into a device similarly provided with a USB port to carry out access operations, and facilitate the needs of people. However, in order to accommodate advancement in technology, the transmission speed feature of the USB needed to be increased, resulting in the development of USB 2.0, which has an even faster transmission rate compared to the original USB. USB 2.0 ports are not only compatible with the original USB, but also support faster speeds, thereby enabling the user to save on working time, and increase efficiency.

However, when USB 2.0 transmission rates were unable to meet user needs, then USB 3.0 was developed. USB 3.0 is similarly compatible with the original USB as well as USB 2.0, and at later periods, different interfaces have been developed, such as E-SATA (External-Serial Advanced Serial Attachment) interfaces, and so on. Moreover, various different interfaces have been developed that combine the three types of interfaces into one structural configuration, thereby eliminating annoyance to the user resulting from having to reinsert. However, the outer casing of connectors of general devices are not provided with a position retaining function, often causing displacement of the connector and errors occurring when in use.

In addition, early in its development, the general USB connector was a USB connecting interface, and such a USB (plug and play) can be said to have provided convenience to many users, the user being able to insert a device provided with a USB interface into a device similarly provided with a USB port to carry out access operations, and facilitate the needs of people. However, assembly methods and specifications of USBs on the current market are practically identical, and thus separate manufacture of a USB with specific structures or requirements cannot be implemented. And should separate manufacture be necessary, then a separate mold must be opened, thereby necessitating an increase in the overall cost, and thus, correspondingly, of no economic benefit.

Hence, it is the strong desire of the inventor and manufacturers engaged in related art and purpose of the present invention to research and improve on the problems and shortcomings of the aforementioned prior art.

SUMMARY OF THE INVENTION

Hence, in light of the shortcomings of the aforementioned prior art, the inventor of the present invention, having collected related data, and through evaluation and consideration from many aspects, as well as having accumulated years of experience in related arts, through continuous testing and improvements, has designed a new connector that enables changing the assembled form according to user needs, while at the same time retaining positioning of the connector.

A primary objective of the present invention lies in providing the connector, wherein a connector is defined with an opening for connecting a USB (Universal Serial Bus) connector. The connector being primarily assembled from a hollow casing, a first base and a second base, in which one end of the hollow casing is defined with the aforementioned opening, and two side walls at the rear of the hollow casing are respectively formed with a position fixing portion extending away from the opening. Moreover, the first base and the second base are fixedly combined together, and after combination, two sides thereof are respectively formed with a guiding portion. The guiding portions are used to enable fixing portions extending from two sides of a printed circuit tongue to effect sliding inserted disposition. After assembly of the bases with the printed circuit tongue, then the fixing portions on the printed circuit tongue are used to enable fastening to the position fixing portions on the hollow casing. Accordingly, the composite structure of the first base and the second base not only enables achieving the objective of product customization, but also at the same time retaining positioning of the connector to is enabled to prevent errors from occurring due to displacement.

Another objective of the present invention lies in also enabling a printed circuit tongue to be used in HDMI (High-Definition Multimedia Interface) and display port two-in-one connectors.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
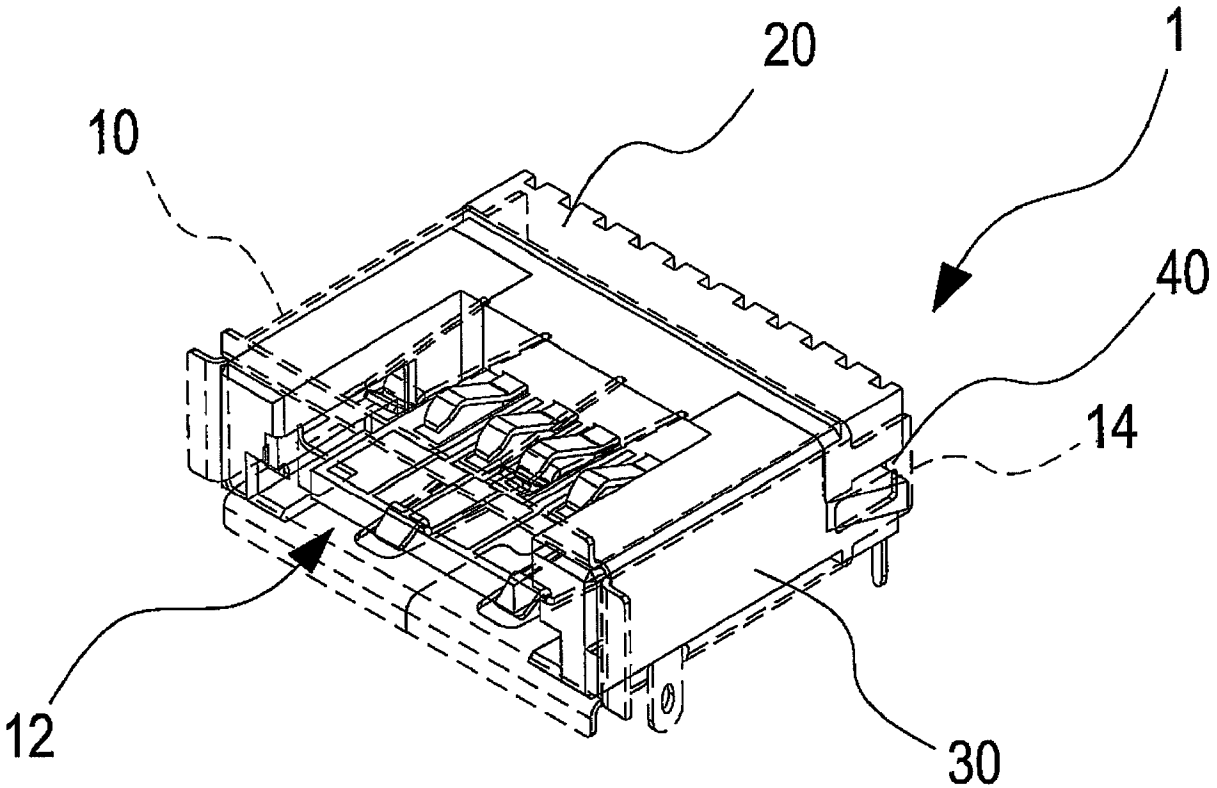
FIG. 1 is an elevational schematic view of a preferred embodiment of the present invention.
Figure 2:
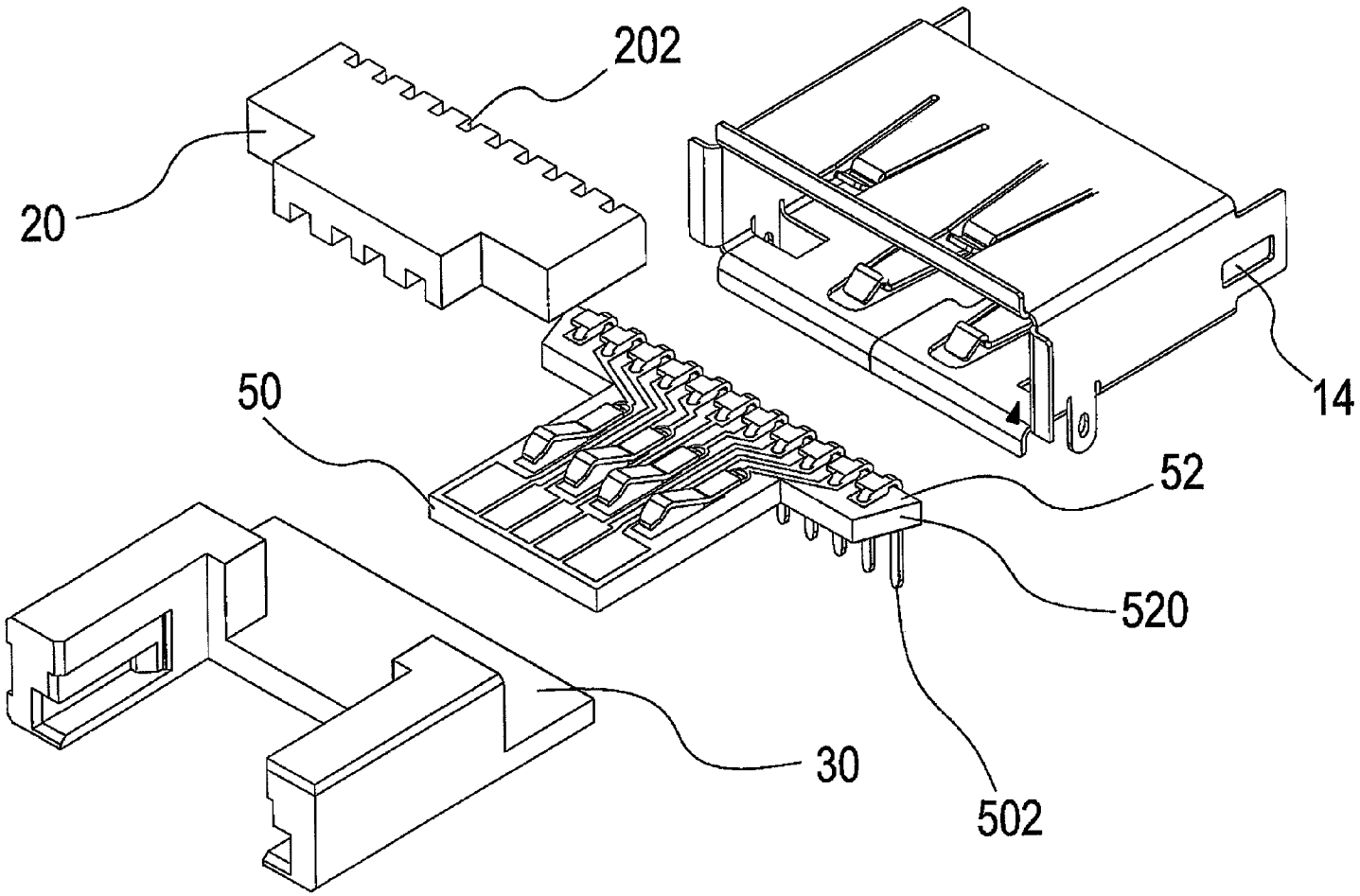
FIG. 2 is an exploded schematic view of the preferred embodiment of the present invention.

Referring to FIG. 1 and FIG. 2, which show an elevational schematic view and an exploded schematic view respectively of a preferred embodiment of the present invention, and it can be clearly seen from the drawings that a connector 1 of the present invention is defined with an opening 12 for connecting a USB (Universal Serial Bus) connector. The connector 1 is primarily assembled from a hollow casing 10, a first base 20 and a second base 30, in which one end of the hollow casing 10 is defined with the aforementioned opening 12, and two side walls at the rear of the hollow casing 10 are respectively formed with a position fixing portion 14 extending away from the opening 12. Moreover, the first base 20 is formed with a plurality of grooves 202, and the grooves 202 are used to enable corresponding disposition of a plurality of pins 502 on a printed circuit tongue 50 therein. In addition, the first base 20 and the second base 30 are fixedly combined together, and after combination, two sides thereof are respectively formed with a guiding portion 40. The guiding portions 40 are used to enable fixing portions 52 provided with inclined surfaces 520 and extending from two sides of the printed circuit tongue 50 to abut therewith to enable sliding inserted disposition. After assembly of the first base 20 and the second base 30 with the printed circuit tongue 50, then the fixing portions 52 on the printed circuit tongue 50 can be used to enable fastening to the position fixing portions 14 (grooves or through holes) on the hollow casing 10.

Figure 3:
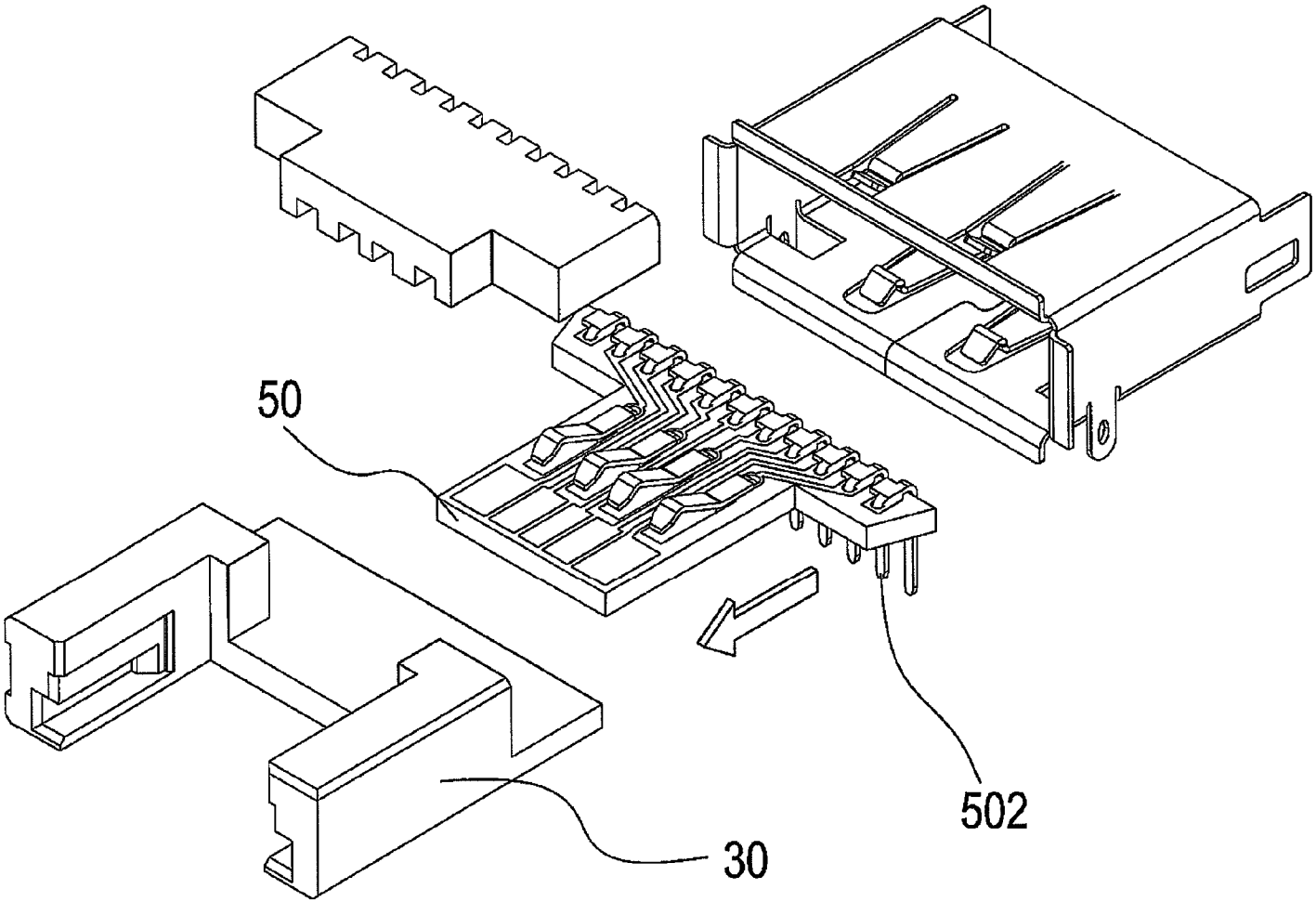
FIG. 3 is an assembling schematic view (I) of the preferred embodiment according to the present invention.
Figure 4:
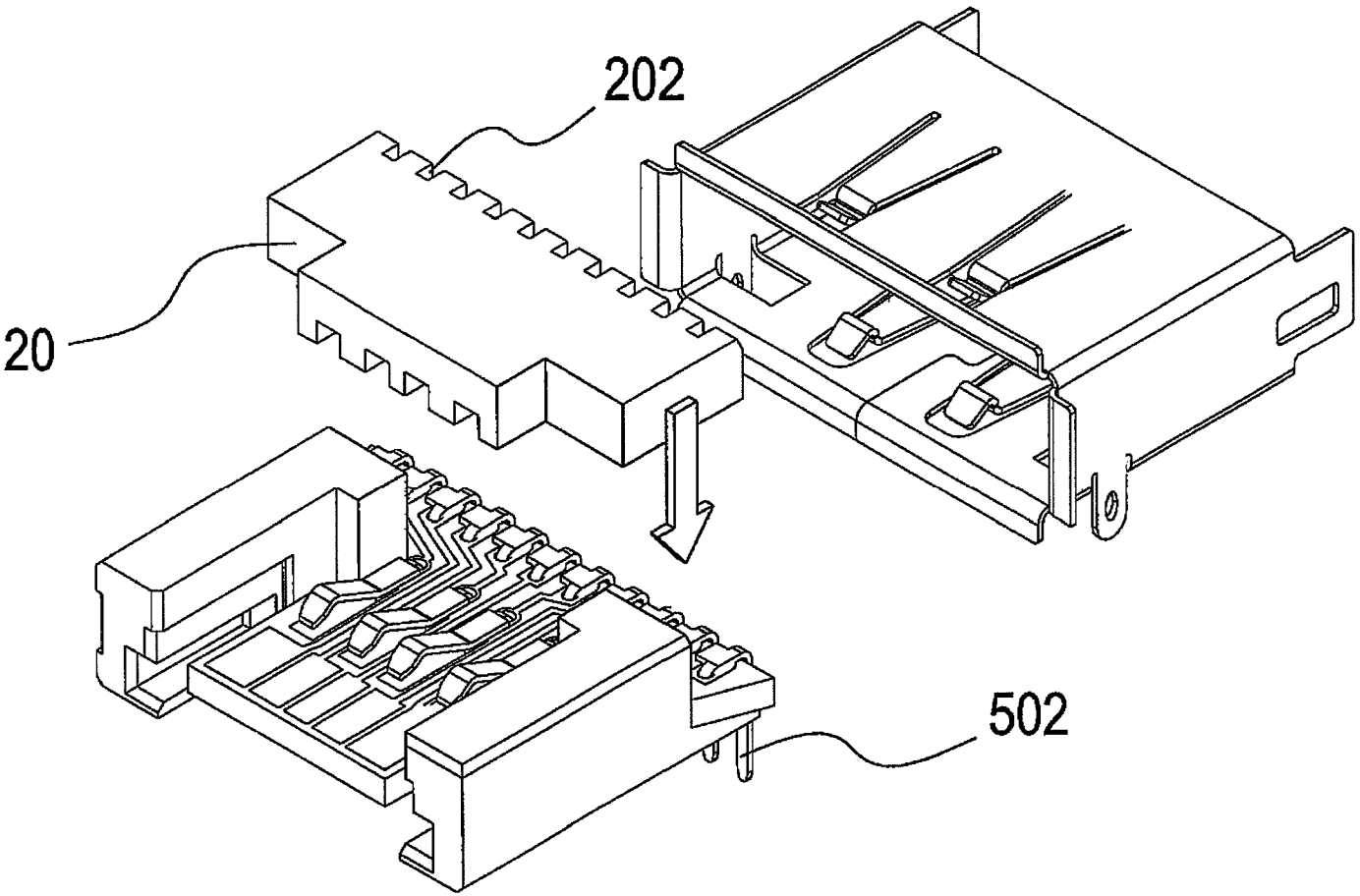
FIG. 4 is an assembling schematic view (II) of the preferred embodiment according to the present invention.
Figure 5:
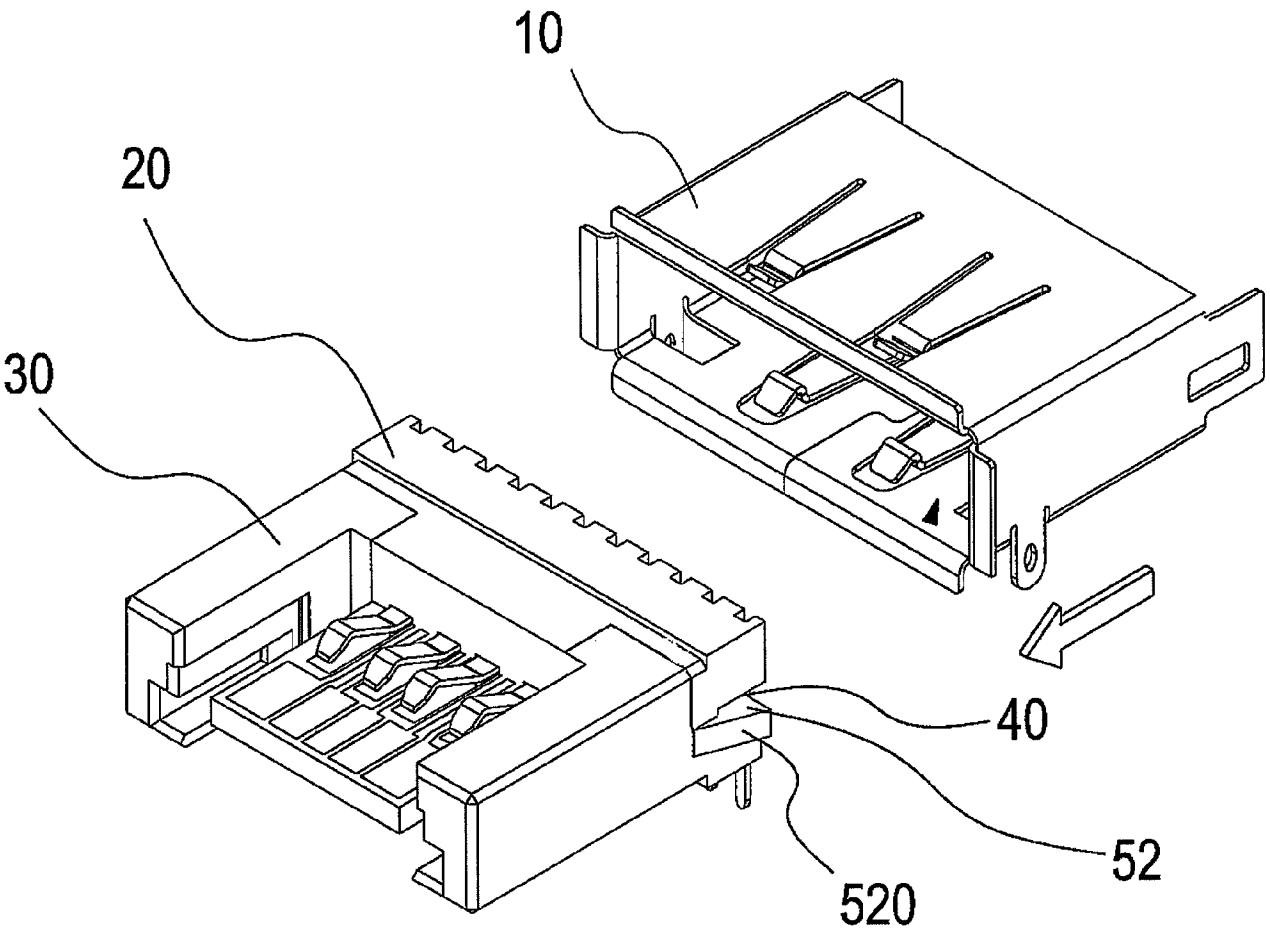
FIG. 5 is an assembling schematic view (III) of the preferred embodiment according to the present invention.

According to the aforementioned structure and constructional design, circumstances during operational use of the present invention are described hereinafter. Referring together to FIG. 3, FIG. 4 and FIG. 5, which show an assembling schematic view 1, an assembling schematic view 2 and an assembling schematic view 3 of the preferred embodiment according to of the present invention, and it can be clearly seen from the drawings that the end of the printed circuit tongue 50 without the pins 502 is first installed to the second base 30, and then the first base 20 is used to cover and press the printed circuit tongue 50, at which time the grooves 202 on the first base 20 correspond with the positions of the pins 502. Hence, according to the structural configuration described above, the composite structure of the first base 20 and the second base 30 is used to achieve the objective of product customization. Accordingly, the completed assembly of the aforementioned first base 20 and second base 30 can be inserted and disposed within the hollow casing 10.

Because of the stepped form of the fixing portions 52 extending from the two sides of the printed circuit tongue 50 forming the inclined surfaces 520, thus, the fixing portions 52 abut against the guiding portions 40 to enable sliding inserted disposition, thereby enabling the printed circuit tongue 50 to be fixedly secured between the first base 20 and the second base 30 using the fixing portions 52.

Figure 6:
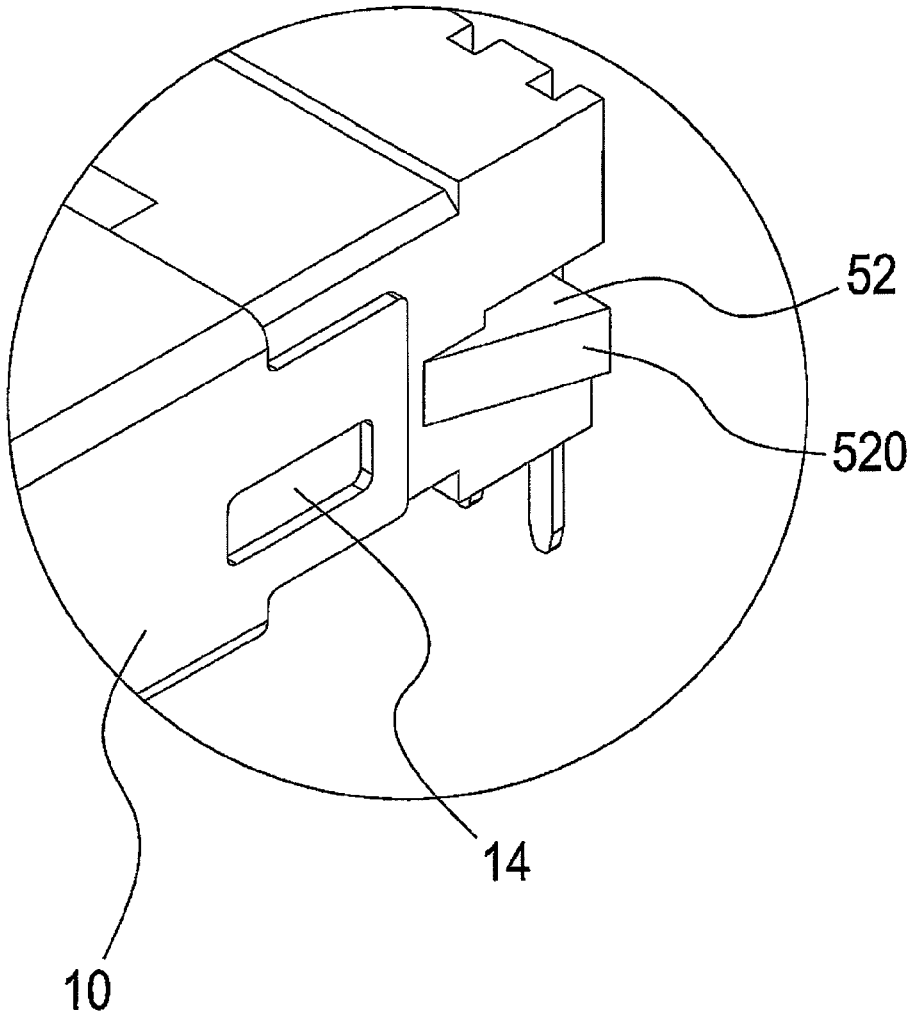
FIG. 6 is a partially enlarged schematic view (I) of a hollow casing and bases of the present invention.
Figure 7:
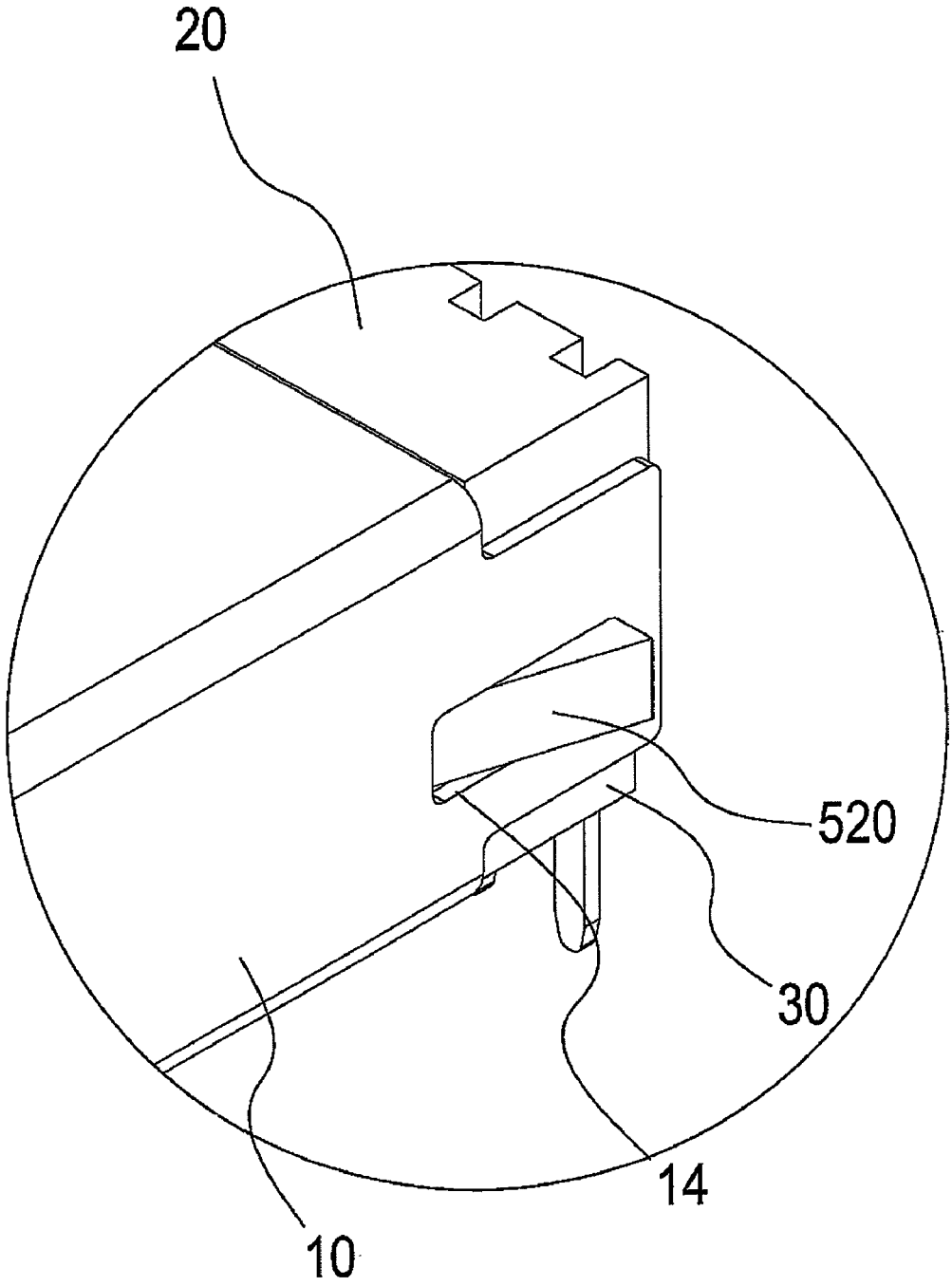
FIG. 7 is a partially enlarged schematic view (II) of a hollow casing and bases of the present invention.

Referring to FIG. 6 and FIG. 7, which show a partially enlarged schematic view (I) and a partially enlarged schematic view (II) respectively of the hollow casing and bases according to the present invention, wherein the inclined surfaces 520 formed on the fixing portions 52 are used to enable holding the configuration in the position fixing portions 14 on the two side walls of the hollow casing 10. Moreover, when the printed circuit tongue 50 (see FIG. 4) or the hollow casing 10 is pressed and pushed inwardly, then mutual stress is produced between the position fixing portions 14 and the inclined surfaces 520, causing the position fixing portions 14 to displace along the inclined surfaces 520 to the bottom portions thereof, thereby achieving the objective of mutual clamping and fixedly securing the first base 20 and the second base 30 to the hollow casing 10. Hence, according to the structural configuration described above, not only is the objective of product customization achieved by use of the bases, but also, at the same time, retaining position of the connector is enabled to prevent errors from occurring due to displacement.

Furthermore, after completing assembly of the hollow casing 10, two-in-one HDMI (High-Definition Multimedia Interface) and display ports (not shown in the drawings) can be additionally used with the printed circuit tongue 50.

Figure 8:
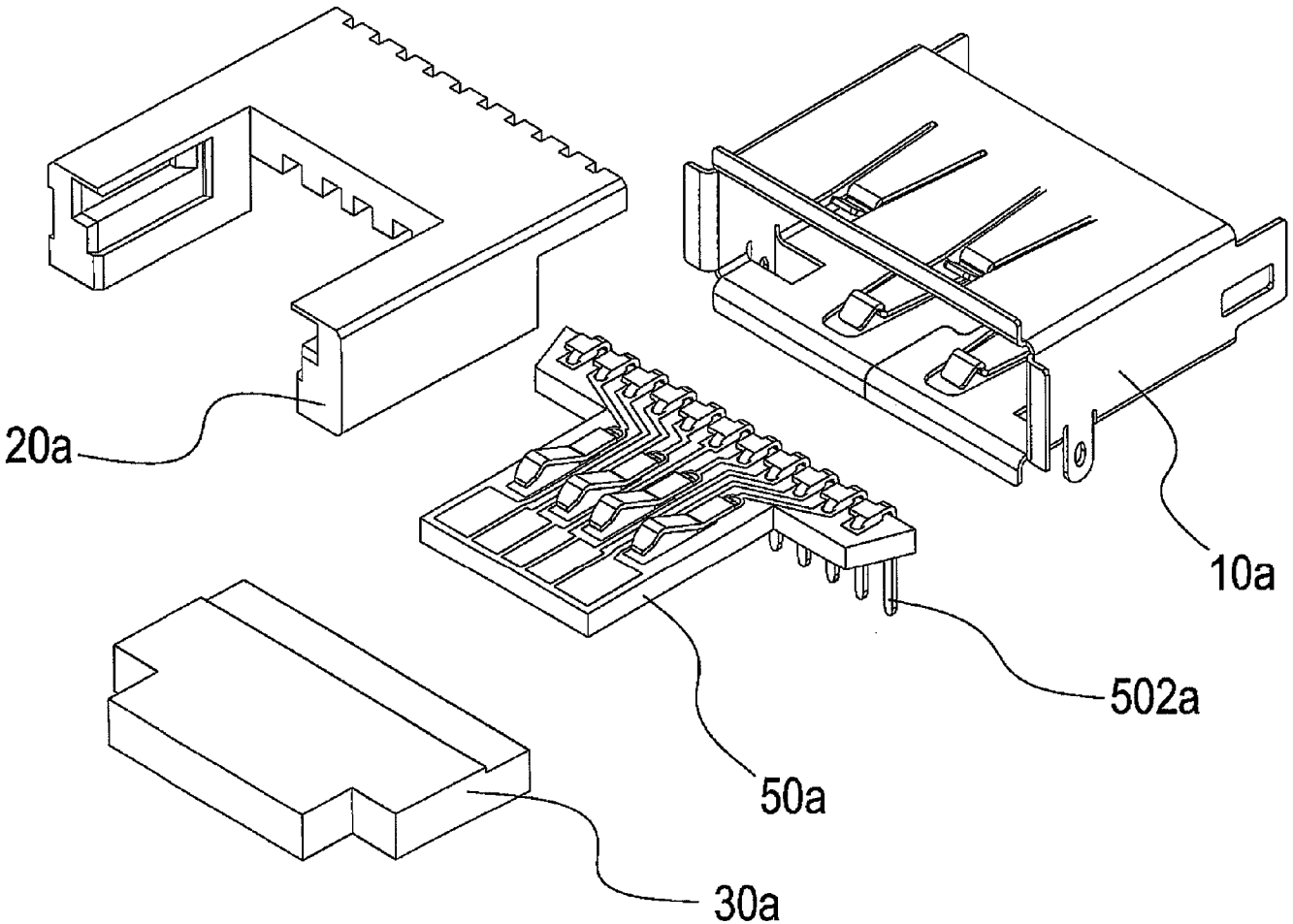
FIG. 8 is an assembling schematic view of another preferred embodiment according to the present invention.

Referring to FIG. 8, which shows an assembling schematic view of another preferred embodiment according to the present invention, and it can be clearly seen from the drawing that the entire assembly method is largely identical except for minor differences to the aforementioned assembly method, in which the method of pressing the first base 20*a* onto and covering the second base 30*a* is changed according to the positions of the pins 502*a* on the printed circuit tongue 50*a*. It is understood that after assembling a hollow casing 10*a*, then two-in-one HDMI (High-Definition Multimedia Interface) and display ports (not shown in the drawings) can be additionally applied on a printed circuit tongue 50*a*.

Figure 9:
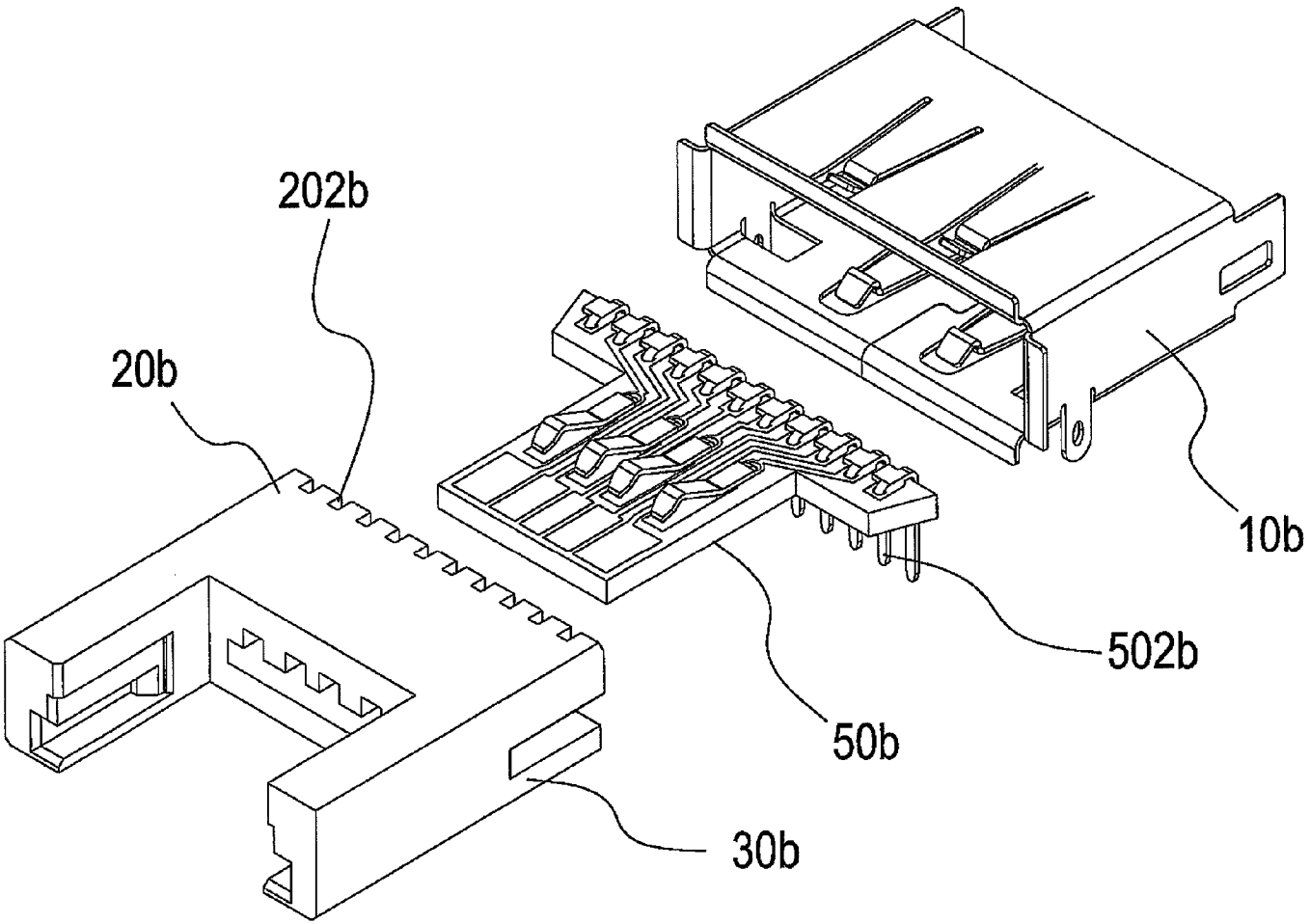
FIG. 9 is an assembling schematic view of yet another preferred embodiment according to the present invention.

Referring to FIG. 9, which shows an assembling schematic view of yet another preferred embodiment according to the present invention, and it can be clearly seen from the drawing that a first base 20*b* and a second base 30*b* are formed as an integral body as an exemplary example, which enables inserted disposition of a printed circuit tongue 50*b* between the first base 20*b* and the second base 30*b*. Moreover, grooves 202*b* formed on the first base 20*b* enable inserted disposition of pins 502*b* on the printed circuit tongue 50*b* therein to prevent deformation of the pins 502*b* from pressing and causing short circuiting. After inserted disposition of the printed circuit tongue 50*b*, such an assembly method only requires assembly in a hollow casing 10*b*, thereby saving assembly time. Furthermore, integral formation of the aforementioned first base 20*b* and second base 30*b* enables the printed circuit tongue 50*b* to be inserted between the first base 20*b* and the second base 30*b* using another insert injection means.

The aforesaid various different assembly methods enable changing to different assembly methods according to needs of the end user, thereby achieving the objective of product customization, and enabling effective control over use of materials and parts to reduce cost thereof.

In conclusion, the connector of the present invention is clearly able to achieve the effectiveness and objectives as disclosed when in use, and is indeed a practical and exceptional invention that complies with the essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A connector defined with an opening for connecting a USB (Universal Serial Bus) connector, the connector comprising:

a first base formed with a plurality of grooves corresponding to a plurality of pins extending on a printed circuit tongue, the printed circuit tongue having a fixing portion extending from each of two sides of the printed circuit tongue;

a second base covering and pressing another surface of the printed circuit tongue to join together with the first base, two sides of a combination of the first base and the second base being each formed with a guiding portion having recess portion to enable receiving of the fixing portion of the printed circuit tongue, the fixing portion of the printed circuit tongue being formed with an inclined surface and abutting against the guiding portion to enable sliding displacement; and a hollow conductive casing defined with the opening, and two side walls at a rear of the hollow casing being respectively formed with a through hole, and the through hole enabling fastening to the fixing portion of the printed circuit tongue;

wherein the hollow casing positions in between the first and second bases.

2. The connector according to claim 1, wherein the first base and the second base are formed as an integral body.

* * * * *